US007346457B2

(12) United States Patent
Jalali et al.

(10) Patent No.: US 7,346,457 B2
(45) Date of Patent: Mar. 18, 2008

(54) METHOD FOR IDENTIFICATION OF INHIBITED WELLS IN THE MATURE FIELDS

(75) Inventors: Younes Jalali, St. Nom la Breteche (FR); Tao Gang, Tulsa, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 232 days.

(21) Appl. No.: 11/388,677

(22) Filed: Mar. 24, 2006

(65) Prior Publication Data

US 2007/0225916 A1 Sep. 27, 2007

(51) Int. Cl.
*G01V 3/18* (2006.01)
*G01F 19/00* (2006.01)

(52) U.S. Cl. ..... 702/12; 702/1

(58) Field of Classification Search ..... 702/1–12; 703/10

See application file for complete search history.

(56) References Cited

U.S. PATENT DOCUMENTS 5,305,209 A 4/1994 Stein et al.
6,980,940 B1 * 12/2005 Gurpinar et al. ..... 703/10
7,289,942 B2 * 10/2007 Yang et al. ..... 703/10
2005/0096893 A1 5/2005 Feraille et al.

FOREIGN PATENT DOCUMENTS

WO WO2004095259 A1 11/2004

OTHER PUBLICATIONS

Anderson, J.S.; "Pressure Mapping as an Aid to Understanding Reservoir Drainage"; Society of Petroleum Engineers, Inc., Asia-Pacific Conference, Perth, Western Australia, Nov. 4-7, 1991; SPE 22962, pp. 173-185.

* cited by examiner

*Primary Examiner*—John Barlow
*Assistant Examiner*—Victor J. Taylor
(74) *Attorney, Agent, or Firm*—Clarence E. Eriksen; Bryan P. Galloway

(57) ABSTRACT

A method is provided for evaluating the performance of a plurality of oil wells which were established to produce from a common reservoir beneath the earth's surface. The method comprises inputting information about the reservoir into a computer and establishing a time interval and time steps within that time interval over which performance of the wells will be evaluated. The total oil which is accessible clearing each time step in each time interval is determining, and then individual recovery factor for each time step is determined. A composite recovery factor is determined using the individual recovery factors, and the composite recovery factors are normalized to the best well in the field.

8 Claims, 3 Drawing Sheets

METHOD FOR IDENTIFICATION OF INHIBITED WELLS IN THE MATURE FIELDS

BACKGROUND OF THE INVENTION

1. Field of the Invention

The present invention relates to a method of identifying under-performing oil wells in a large field with a long production history.

2. Description of the Prior Art

Initial hydrocarbon production from subterranean reservoirs is generally referred to as "primary" production. During primary production, only a fraction of the hydrocarbon in the reservoir is recovered. Thereafter, additional hydrocarbons may be recovered by employing enhanced hydrocarbon recovery techniques e.g. by injecting fluids such as water, steam, nitrogen, CO2 or natural gas into the reservoir and such subsequent production is generally referred to as "secondary" or "tertiary" production. Enhanced recovery techniques generally depend on the injected fluid to displace the hydrocarbon from its in-situ location and direct it towards a producing well from which it can be recovered. Because of the substantial economic cost required to develop and implement enhanced recovery techniques, it is critically important for a reservoir engineer to characterize the storage and flow capacity of a hydrocarbon bearing reservoir.

Experience in the petroleum industry has indicated that reservoir storage and flow parameters obtained from geological, geophysical and petrophysical data can be used to develop a model of the reservoir and thereafter the model can be inputted into a numerical reservoir simulator to obtain predictions of reservoir response or performance during enhanced hydrocarbon recovery. The goal of such numerical reservoir simulators is to predict reservoir performance in more detail and with more accuracy than is possible with simple extrapolation techniques.

An analytical technique for estimating well drainage areas in well reservoirs is disclosed by J. S. Anderson in the paper entitled "Pressure Mapping as an Aid to Understanding Reservoir Drainage," SPE 22962 (1991). That technique is based on calculating reservoir pressure throughout the field in question and producing pressure maps over the field. According to Anderson, streamlines tracing the path of fluid toward the well can be plotted and drainage areas can be discerned from the pressure mapping. Anderson discloses a mathematical/analytical technique which is believed to be suitable for use with simple reservoirs, e.g., those having homogeneous properties and/or simple geometries.

No method has heretofore been developed which is based on numerical methods which can handle more geologically realistic reservoir descriptions, which uses the drainage area concept specifically to determine the recovery efficiency of the wells and how this evolves over field life, and which uses the concept of recovery efficiency on a well-by-well basis to identify inhibited wells or wells with erroneous (i.e., systematic under-reported/under-allocated) production figures. These results have been achieved by the method of the present invention.

SUMMARY OF THE INVENTION

A method in accordance with the present invention utilizes information respecting reservoir size and shape, individual well locations, and production/injection history of wells and in one embodiment, a method according to the present invention scans a reservoir model to extract such information. A method in accordance with the present invention then estimates the volume of oil accessible to each individual well for a plurality of time steps during a time period in the life of oil from the well. Following this estimation, the actual production of the well is compared to the amount of oil that was accessible to it and an individual well recovery factor is determined for each time step, as well as a history of the recovery factors over the life of the field. A method in accordance with the present invention then determines the overall recovery factor of the well which is its composite performance over the life of the field and ranks the wells in the field by normalizing their composite recovery factors based on the best well in the field. This ranking may then be used to determine which well or wells require closer attention for additional measurements and tests. Such tests may prove that there is nothing wrong with the identified wells, which in turn proves that there was something wrong with the reported production figures (under-allocated production), hence also something wrong with the underlying reservoir model which is based on those production figures.

DESCRIPTION OF SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

In this specification and the appended claims the term "reservoir model" is used to denote a database which may, for example, contain information on reservoir shape and size, geological characteristics, initial fluid distribution, fluid properties, well locations and profiles, and the production history of all wells. Such a reservoir model is typically prepared through a mathematical representation of information derived from seismic, geology, petrophysics, testing fluid analysis, and production data. A reservoir model for use in the method of the present invention needs to be in a standard format that is contained in commercial reservoir simulation software packages, such as the Eclipse software package, which is available from the assignee of the present invention. A method in accordance with the present invention utilizes three pieces of information which are contained in a reservoir model, namely: reservoir size/shape, well locations, and production/injection history of the wells.

Figure 1:
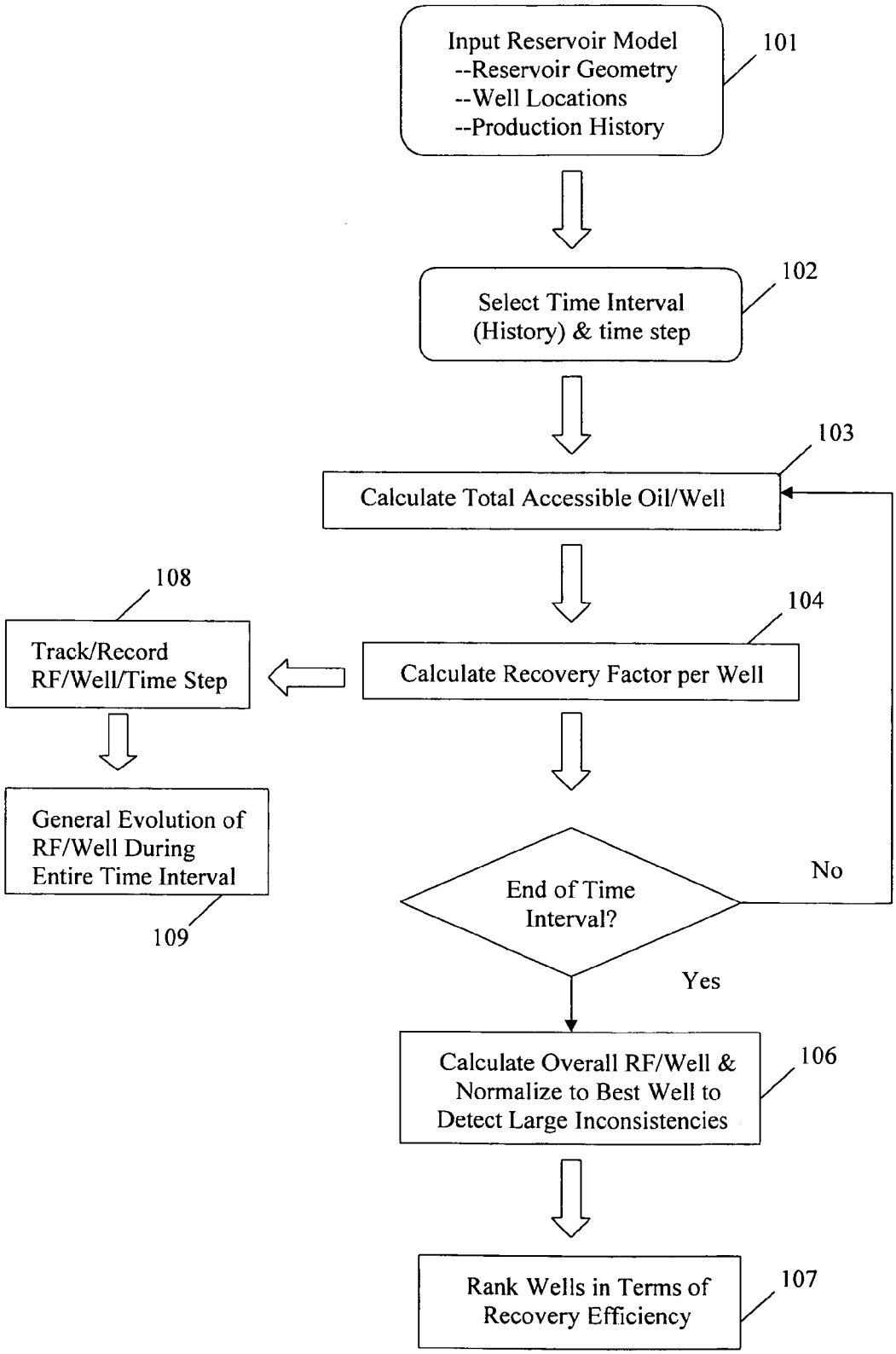
FIG. 1 is a flowchart which illustrates a method in accordance with the present invention.

With reference first to FIG. 1, the first step 101 in a method in accordance with the present invention is to input information concerning reservoir size and shape, individual well locations and production/injection history into a digital computer. In one embodiment such information may be inputted directly into the digital computer, while in another embodiment, such information may be obtained from a reservoir model which is inputted into a digital computer. Where a reservoir model is used, the reservoir model may be treated as a database and scanned to determine the inhibited wells in accordance with the present invention. Once the reservoir model has been provided as an input the next step 102 in a method according to the present invention is to select the time interval and time step. The time interval may be any time period in the life of the well from initial production to the present time. The time step is determined by the frequency with which the production data in the reservoir model is recorded. Typically, the time step may be one month and the time interval may be several months or years.

Figure 2:
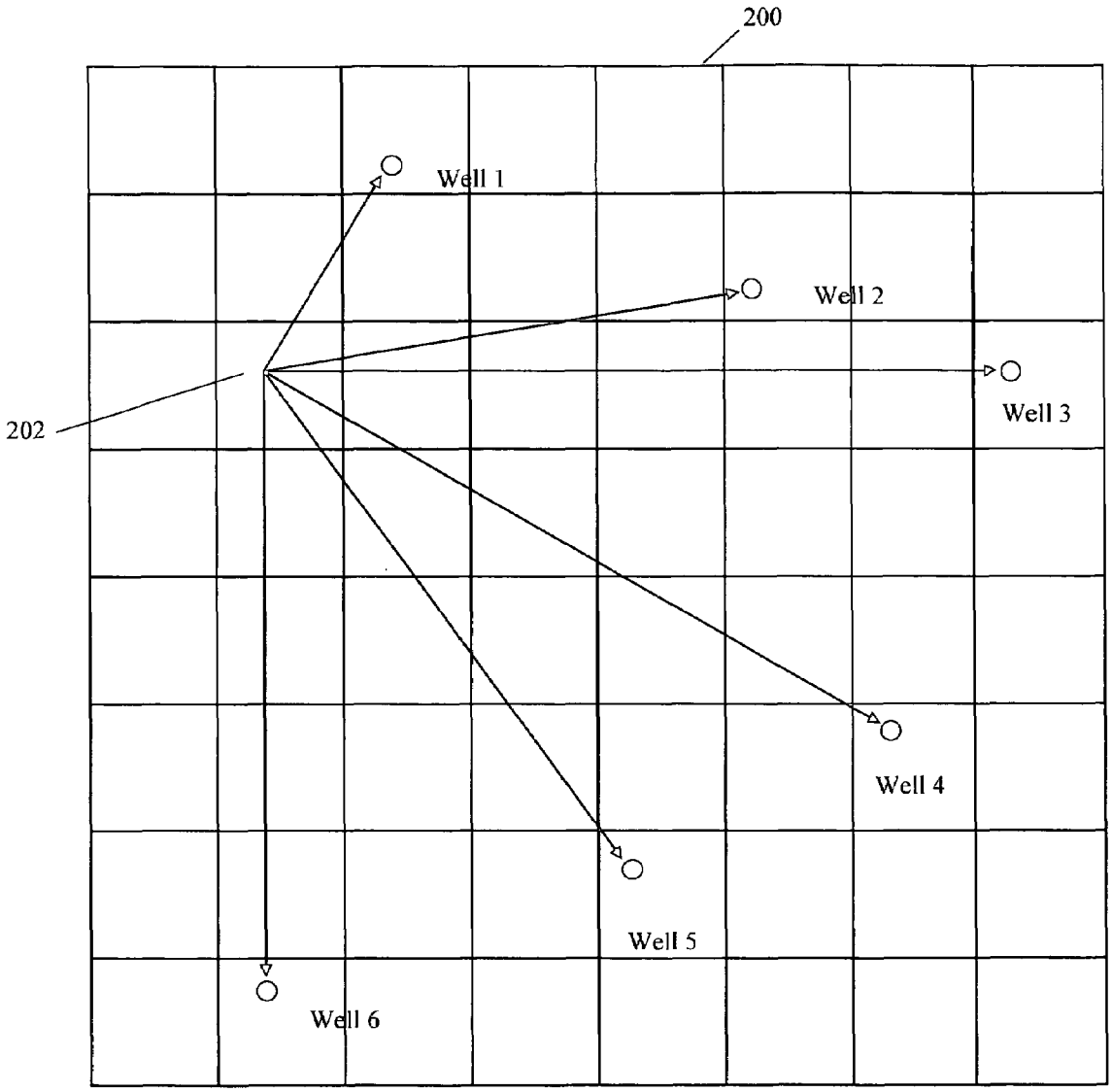
FIG. 2 is a pictorial diagram which illustrates a portion of method by which attraction forces are calculated.

The next step 103 in a method in accordance with the present invention is the calculation of the total accessible oil that was available for each well of the reservoir during that time step. With reference now to FIG. 2, the calculation of the Total Available Oil per well for each time step is described. A grid is superimposed over the reservoir 200 and the grid overlaps the reservoir 200 and six hypothetical wells which are designated well 1-well 6 in FIG. 2 have been established to produce from the reservoir. The grid comprises a plurality of cells 202, where the total number of cells in the grid is equal to $^{n}$. The attractive force may be defined as $$F_{ij} = \frac{Q_j}{d_{ij}^2}$$

where $^{F}{}_{ij}$ is the attractive force between cell i and well j; $Q_j$ is the flow rate of well i; and $d_{ij}$ is the distance between cell i and well j.

In accordance with the method of the present invention, drainage volume may be calculated by the following equation:

$$V_j = \sum_{i=1}^{n} \left( PV_i \cdot \frac{F_{ij}}{\sum_{j=1}^{nw} F_{ij}} \right)$$

where $V_j$ is the drainage volume of well j; $PV_i$ is the pore volume of cell i; $F_{ij}$ is the "Attraction Force" between cell i and well j; n represents the total number of cells in the reservoir; and nw represents the total number of producing wells in the reservoir.

In accordance with the present invention, the Total Accessible Oil (TAO) for each well j in the reservoir is then determined by the equation $$\mathrm{TAO}_j = V_j \cdot \overline{S}_o$$

where $\overline{S}_o$ is the average oil saturation.

A recovery factor is then calculated for each well for that time step. The recovery factor for each well is determined by the ratio of the actual production from the well during that time step to the total amount of oil that was accessible to that well in that time step. When the recovery factor for each well has been calculated for each time step in the time interval, a composite overall recovery factor for the well may be determined in step 106 of FIG. 1. For example, the composite overall recovery factor for each well may be determined by averaging the recovery factors determined for each time step. This composite overall recovery factor is indicative of the composite performance of the well over the time interval, and if the time interval is chosen to be from the start of production to the present, the composite overall recovery factor is indicative of the composite performance of the well over its field life.

Figure 3:
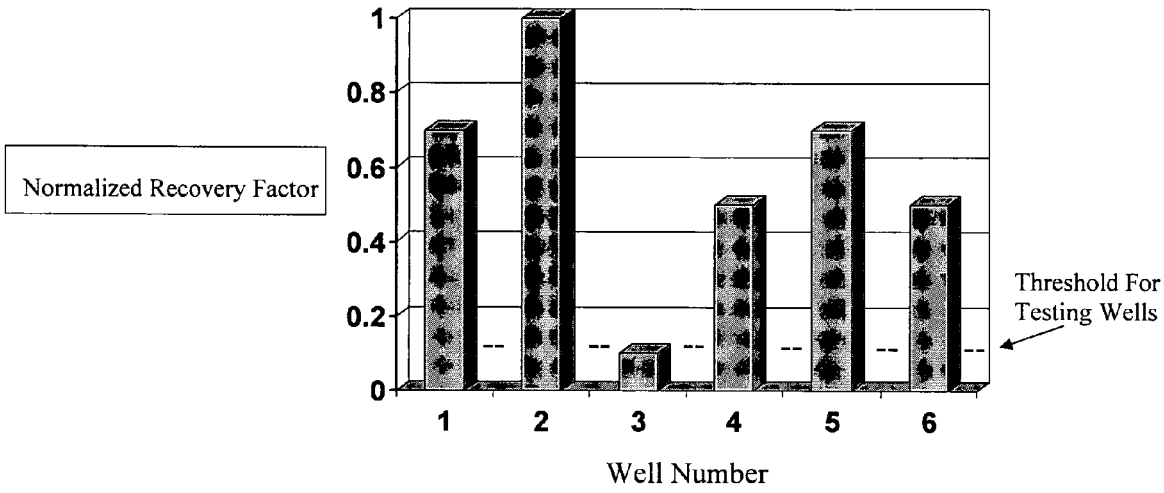
FIG. 3 is a bar graph which illustrates normalization of composite recovery factors.

Lastly, the wells are ranked by normalizing their composite overall recovery factors to the best well in the field, and this ranking can then be used to decide which wells need closer attention for additional measurements and tests. With reference to FIG. 3, a ranking of hypothetical composite overall recovery factors for the six wells of FIG. 2 is illustrated.

Referring again to FIG. 1, a method in accordance with the present invention may further comprise the step 108 of trailing and recording the recovery factor that was obtained for each time step and the step 109 generating an evolution of recovery factors for all of the time steps in a particular time interval to see how each well performs in the overall competition between all wells.

What is claimed is:

1. A method of evaluating the performance of a plurality of oil wells which were established to produce from a common reservoir beneath the earth's surface, comprising:

a) inputting information into a digital computer respecting the size/shape of the reservoir, the locations of the wells and the production/injection history of the wells;

b) establishing a time interval and time steps within said time interval over which the performance of the wells will be evaluated;

c) determining the total oil which is accessible to each said well in each time step in said time interval;

d) determining an individual recovery factor for each well for each time step in said time interval, where said recovery factor is defined as the ratio of actual production from each well during said time step to total oil accessible to each said well;

e) determining a composite overall recovery factor for each said well over the time interval.

2. The method of claim 1, further comprising the steps of normalizing the composite overall recovery factors to the best well in the field.

3. The method of claim 1 further comprising the step of detecting wells with inhibited reservoir potential or under-reported/under-allowed production.

4. The method of claim 1, wherein step (a) comprises establishing a reservoir model in the digital computer and scanning the reservoir model to obtain the specified information.

5. The method of claim 1, wherein the determination of step (c) comprises:

establishing a grid over the expanse of the reservoir where said grid comprises a plurality of cells (n);

determining the attractive force between each cell and each well using the formula $$F_{ij} \frac{Q_j}{d_{ij}^2}$$

where $F_{ij}$ is the attractive force between cell; and well j, $Q_j$ is the flow rate of well j at the time step in question, and $d_{ij}$ is the distance between cell i and well j;

calculating the drainage volume $V_j$ of each well using the formula $$V_j = \sum_{i=1}^{n} \left( PV_i \cdot \frac{F_{ij}}{\sum_{j=1}^{nw} F_{ij}} \right)$$

where $V_j$ is the draining volume of well j, PV is the pore volume of cell i, $F_{ij}$ is the attractive force between cell i and well j, n represents the total number of producers; and determining the total oil which is accessible for each well using the formula $$TAO_j = V_j \cdot \overline{S}_o$$

where $\overline{S}_o$ is the average oil saturation.

6. The method of claim 1, wherein the composite overall recovery factor for each well over the time interval is determined by averaging the individual recovery factors for each well.

7. The method of claim 1, further comprising the steps of recording the recovery factor obtained for each time step and generating an evolution of the recovery factors for all of the time steps in a particular time.

8. The method of claim 1, further comprising the step of determining whether one or more of the wells have non-reservoir factors inhibiting production or whether production from one or more of the wells has been under-allocated.

* * * * *